United States Patent [19]

Zitelli

[11] 4,096,699

[45] Jun. 27, 1978

[54] AUXILIARY MANUAL TURBINE CONTROLLER

[75] Inventor: William E. Zitelli, Monroeville, Pa.

[73] Assignee: Westinghouse Electric Corp., Pittsburgh, Pa.

[21] Appl. No.: 771,290

[22] Filed: Feb. 23, 1977

[51] Int. Cl.[2] ..... F01K 13/02

[52] U.S. Cl. ..... 60/657; 60/646; 60/660; 415/36; 415/15; 251/131

[58] Field of Search ..... 60/660, 646, 657; 290/40 R, 51, 52; 137/624.11, 624.12, 624.18; 415/13, 15, 36; 251/131; 364/300

[56] References Cited

U.S. PATENT DOCUMENTS

| | | | |
|---|---|---|---|
| 3,741,246 | 6/1973 | Braytenbah | 60/660 X |
| 3,911,286 | 10/1975 | Uram | 60/646 X |

*Primary Examiner*—Allen M. Ostrager
*Attorney, Agent, or Firm*—H. W. Patterson

[57] ABSTRACT

A steam turbine control system comprising a primary and an auxiliary manual turbine controller, each said turbine controller including a set of valve position setpoint controllers for close-loop control of the turbine steam admission valves, is disclosed. Each valve position setpoint controller operates, at times, on a position error signal to generate a valve position control signal which controls the rate of valve position movement of a corresponding turbine steam admission valve. The steam admission valves are closed-loop controlled by a selected set of said primary and auxiliary valve position setpoint controllers. The set of valve position control signals corresponding to the selected set of position setpoint controllers are coupled to their respective turbine steam admission valves for controlling the rate of position movement therein. The valve position error and position control signals of the unselected set of said controllers are maintained at approximately zero potential. Transfer logic is provided to coordinate the selection of the primary and auxiliary controllers.

9 Claims, 6 Drawing Figures

AUXILIARY MANUAL TURBINE CONTROLLER

BACKGROUND OF THE INVENTION

This invention relates to steam turbine control systems and more particularly to an auxiliary manual backup steam turbine control system.

Typically, in a primary turbine control system of the digital electro-hydraulic (DEH) type, a central turbine controller generates valve position setpoints to a plurality of steam admission valve setpoint controllers to control turbine speed and load. Each valve setpoint controller individually performs closed-loop position control of its respective steam admission valve mechanism. In some turbine control systems, the steam valves may be controlled with either a single valve mode signal, wherein all valves are positioned according to a common position setpoint, or individual sequential valve mode signals, wherein valve groupings are sequenced in position according to a predetermined pattern based on turbine load demand.

Generally combined with the central turbine controller in the primary control system is a manual backup system utilized for the purposes of automatically assuming control of the turbine upon detection of a malfunction in the central turbine controller. The backup system usually tracks the common single valve mode position setpoint generated by the DEH type central turbine controller such that a transfer of control to the manual backup system will not result in a change of position setpoint value. In one DEH type primary turbine control system, the single valve mode position setpoint is maintained at zero potential when in the sequential valve mode. Under these conditions, if the central turbine controller is automatically transferred to the manual backup controller, the sequential position setpoints will be maintained. After transfer, the valves are positioned by the manual backup system with the common single valve setpoint. It is possible for the valve setpoint controllers to have position setpoint contributions from both the sequential position setpoint of the central controller and single position setpoint of the manual backup controller concurrently. Turbine control operation in this state is neither considered single nor sequential, but rather some combination of both.

The recent DEH type turbine controllers, such as the ones disclosed in U.S. Pat. No. 3,934,128, by Uram, issued Jan. 20, 1976 and U.S. Pat. No. 3,878,401, by Ronnen, issued April 15, 1975 provide means to track the valve positions while the turbine is under control of the manual backup system and means to accept the transfer of control thereto from any possible combination of single-sequential manual valve position state. Typical manual backup controllers and their transfer interactions with a central turbine controller in a primary control system of the DEH type are disclosed in U.S. Pat. No. 3,552,872 by Giras et al., issued Jan. 5, 1971 and U.S. Pat. No. 3,741,246 by Braytenbah, issued June 26, 1973.

While the central and manual backup controllers of the primary control system normally control the turbine in an exclusive "or "ed manner, they are, however, structurally for the most part an integral turbine control system. For example, both controllers are typically housed in the same enclosures, powered from common power sources and operate with common valve position controllers. It is understood, then, that if service or repairs are to be made to either controller during turbine operation, the controlling one is vulnerable to a serviceman's maneuvering within the enclosure. The possibility of an accidental turbine trip due to an inadvertent movement of the serviceman's hand is always present during a servicing operation. Considering the cost involved with the loss of power production associated with an accidental turbine trip, it may be attractive to have an auxiliary turbine control system to control the turbine steam admission valves during relatively short servicing periods of the primary control system. An auxiliary system which could be physically isolated from a primary system, such as a DEH controller, and have a minimum of interface signals may be desirable.

Complications arise in coordinating control of such an auxiliary system with the primary turbine control system as a result of the present day sophistication used in turbine control. DEH type control systems such as those previously mentioned in U.S. Pat. Nos. 3,934,128 and 3,878,401 use a priority structured, multi-tasked, programmed controller. To modify the turbine control programming for the purposes of coordinating transfer control between such systems is considered, for the most part, economically impractical.

Quite often, it is required that a turbine control transfer does not significantly affect the steam admission valve positions. This is more commonly referred to as a "bumpless transfer". The invention has conformed to this requirement by taking special care in selecting the control points utilized for physically switching turbine control between the primary and auxiliary systems, and also, by providing means in each system to prepare in anticipation of a control transfer therebetween. Sequential and single valve control mode combinations such as that described above add further difficulties in the anticipated preparation for transfer; however, such difficulties are also overcome by the present invention.

SUMMARY OF THE INVENTION

The invention relates broadly to an electronic auxiliary manual (AM) steam turbine control system which is utilized primarily for control of hydraulically operated steam turbine admission valves at times when the primary steam turbine control system is being serviced. The auxiliary manual (AM) controller is powered by an independent power source, is isolated from the primary control system and contains essentially no common electronic apparatus with the primary control system.

More specifically, each of the primary and auxiliary manual control systems contains a position setpoint closed-loop controller for each of the steam admission valves of the steam turbine for controlling the position thereof. Primary and auxiliary position signals are generated from each valve as an indication of actual valve position by a position detection means coupled to each valve. A position setpoint for each of the position controllers is generated in both the primary and auxiliary manual control systems to govern the position of each valve. The position errors between each position setpoint and corresponding primary position signal of the primary control system governs their respective setpoint controllers to produce a primary hydraulic fluid flow control signal for each steam admission valve. Likewise, the position errors between each position setpoint and corresponding auxiliary position signal of the auxiliary control system governs their respective setpoint controllers to produce an auxiliary hydraulic fluid flow control signal for each steam admission valve. A set of switches is used to select either the primary or the auxiliary hydraulic fluid flow control signals to control the rate of position movement of each of their respective steam turbine admission valves.

At times when the primary hydraulic fluid flow control signals are selected, the primary control system controls the steam turbine by governing the positions of the steam admission valves. Unless steam flow demand is changing, the steam admission valves are at steady-state conditions, in which case, the primary fluid flow control signals are at a value which affects no significant movement of the valve positions. During the time when the primary control system is controlling the steam turbine, the auxiliary manual control system is tracking its position setpoints to their respective auxiliary position signals such to affect zero position error in each of the position setpoint controllers of the auxiliary manual control system. In addition, the unselected auxiliary hydraulic fluid flow control signals are maintained at a value which will effect essentially no movement of the valve positions.

Accordingly, at times when the auxiliary hydraulic fluid flow control signals are selected, the auxiliary manual control system controls the steam turbine by governing the positions of the steam admission valves. Unless the valves are being manually controlled to a new setting, they are at steady-state conditions and the auxiliary fluid flow control signals are at a value which affects no significant movement of the valve positions. During the time when the auxiliary manual control system is controlling the steam turbine, the primary control system is tracking its position setpoints to their respective primary position signals such that zero position error is effected in each of the position setpoint controllers of the primary control system.

Since the selected and unselected hydraulic fluid flow control signals are of the same approximate value at the time of transfer between the primary and auxiliary manual control systems, no significant instantaneous change in valve position will result because of said transfer. In addition, since the position errors of the setpoint controllers of the primary and auxiliary manual control systems are both approximately zero before transfer therebetween, then no significant valve movement will occur after a transfer is completed as a result of said transfer, whereby it is apparent that no appreciable effect on power plant operation is produced by a transfer of steam turbine control between the two systems.

The transfer of control to the primary system is controlled by the auxiliary system, whereby when said transfer is initiated, an attempt is made by the auxiliary system to transfer control of the steam turbine to the primary system. If any of the valve position setpoints of the primary system is not tracked to its respective primary valve position signal within a predetermined limit, acceptance of the transfer will not be acknowledged by the primary system and steam turbine control will be reverted to the auxiliary system. Only at times when the primary system acknowledges acceptance of control will the control transfer occur therebetween.

DESCRIPTION OF THE PREFERRED EMBODIMENT

Figure 1:
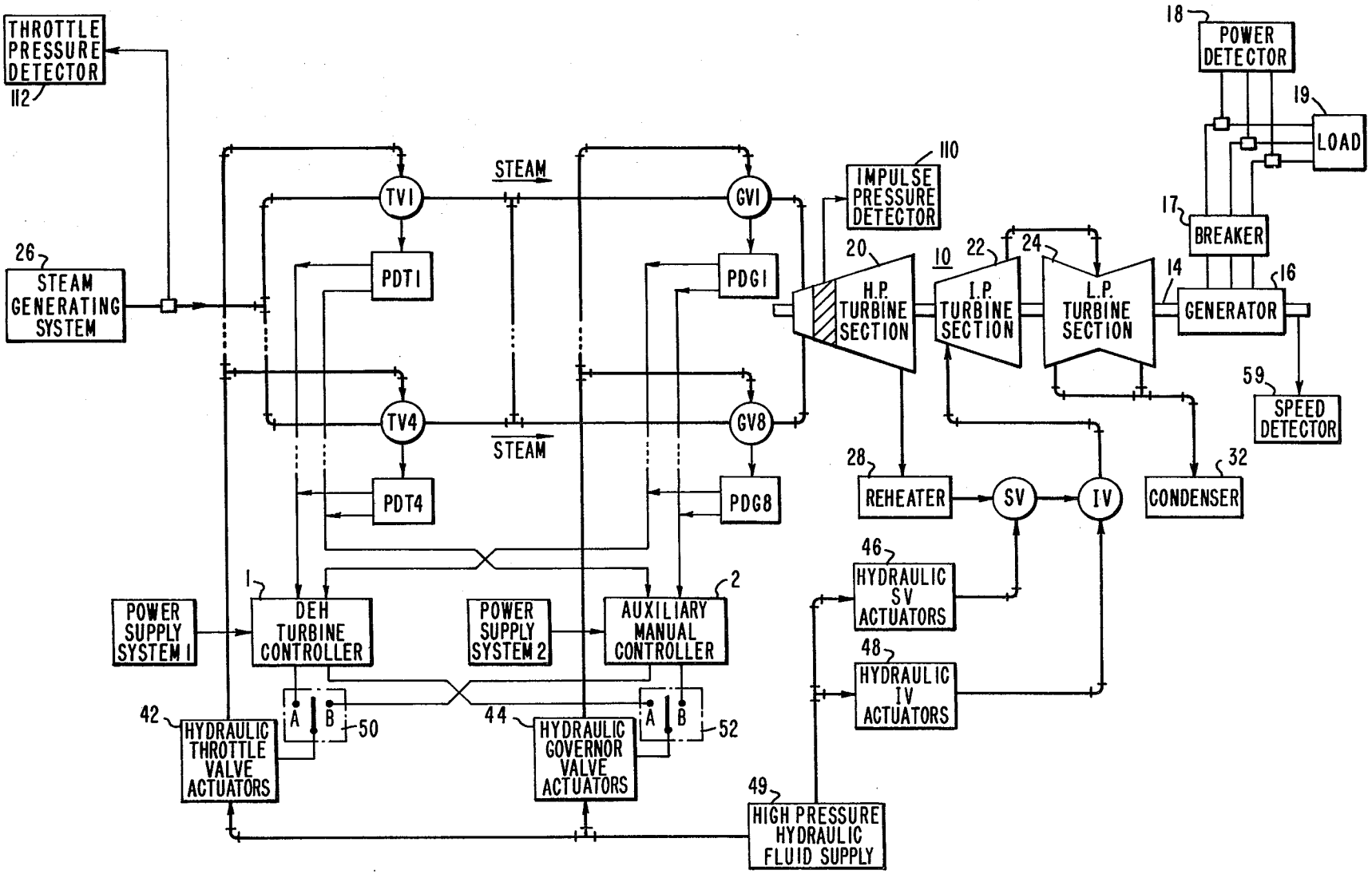
FIG. 1 is a schematic block diagram of a steam turbine power plant in which the present invention is embodied.

Referring to FIG. 1, steam is generated by conventional means in a steam generating system 26 and conducted through a plurality of throttle type TV1, . . . , TV4 and a plurality of governor type GV1, . . . , GV8 steam turbine admission control valves to the inlet of a high pressure (HP) section 20 of a single reheat steam turbine 10. The governor valves GV1, . . . , GV8 and throttle valves TV1, . . . , TV4 may be arranged in any of the conventional arrangements such as a single or double ended steam chest, "one-on-one" and Y-connection, for example, The exhaust steam of the HP section 20 is reheated by reheater 28 and conducted through a plurality of stop valves, SV, and interceptor valves, IV, prior to entering intermediate pressure (IP) and low pressure (LP) turbine sections 22 and 24, respectively. Steam exiting from the LP turbine section 24 enters condenser 32. As the steam expands through the steam turbine 10, a torque is developed in a rotating turbine shaft 14 which is used to drive an electrical generator 16. Power is produced in generator 16 and provided to a load 19 through main generator breakers 17.

The plurality of stop valves, SV, and plurality of interceptor valves, IV, are fully opened by the hydraulic SV actuators 46 and hydraulic IV actuators 48 once the high pressure hydraulic fluid supply 49 reaches a predetermined pressure level. This is normally referred to as "latching" the turbine hydraulic system. Various parameters within the turbine-generator process are monitored for possible use by turbine control systems 1 and 2, as the case may be. For example, speed is measured by a speed detector 59, power by a power detector 18. Also, steam flow may be measured as a function of throttle pressure and HP impulse chamber pressure, representative values of which are provided by detectors 112 and 110, respectively.

The electronic turbine controller 1, typically of the digital electro-hydraulic (DEH) type, controls the positions of the plurality of throttle valves TV1, . . . , TV4, utilizing TV hydraulic valve actuators 42 at times when the plurality of selector switches 50 are in position A. The turbine controller 1 also controls the positions of the plurality of governor valves GV1, . . . , GV8, utilizing GV hydraulic valve actuators 44 when the plurality of switches 52 are in position A. Accordingly, an electronic auxiliary manual controller 2 controls both the throttle valves TV1, . . . , TV4 and governor valves GV1, . . . , GV8, using the same TV and GV hydraulic actuators 42 and 44, respectively, at times when the plurality of switches 50 and 52 are both in the position B. Power supply system 1 and power supply system 2 provide power from independent sources to the turbine controller 1 and the auxiliary manual controller 2, respectively. Throttle valve position detectors PDT1, . . . , PDT4 and governor valve position detectors PDG1, . . . , PDG8 provide signals representative of the throttle valve TV1, . . . , TV4 and governor valve GV1, . . . , GV8 positions to both the turbine controller 1 and auxiliary manual controller 2. These valve position signals allow each controller 1 and 2 to control the position of the plurality of steam admission valves in a conventional closed-loop manner.

It is understood that the steam turbine power plant of FIG. 1 is a typical plant and that other arrangements and combinations of steam turbine sections are possible without deviating from the principles of the invention as will become more apparent in the description presented herebelow. The turbine controller 1 may be of the DEH type disclosed in U.S. Pat. No. 3,934,128 titled "System And Method For Operating A Steam Turbine With Improved Organization Of Logic And Other Functions In A Sampled Data Control" by Robert Uram, issued Jan. 20, 1976 and U.S. Pat. No. 3,878,401 titled "System And Method For Operating A Turbine-Powered Electrical Generating Plant In A Sequential Mode" by Uri G. Ronnen, issued Apr. 15, 1972 which are incorporated by reference herein for a more detailed understanding thereof.

Figure 2:
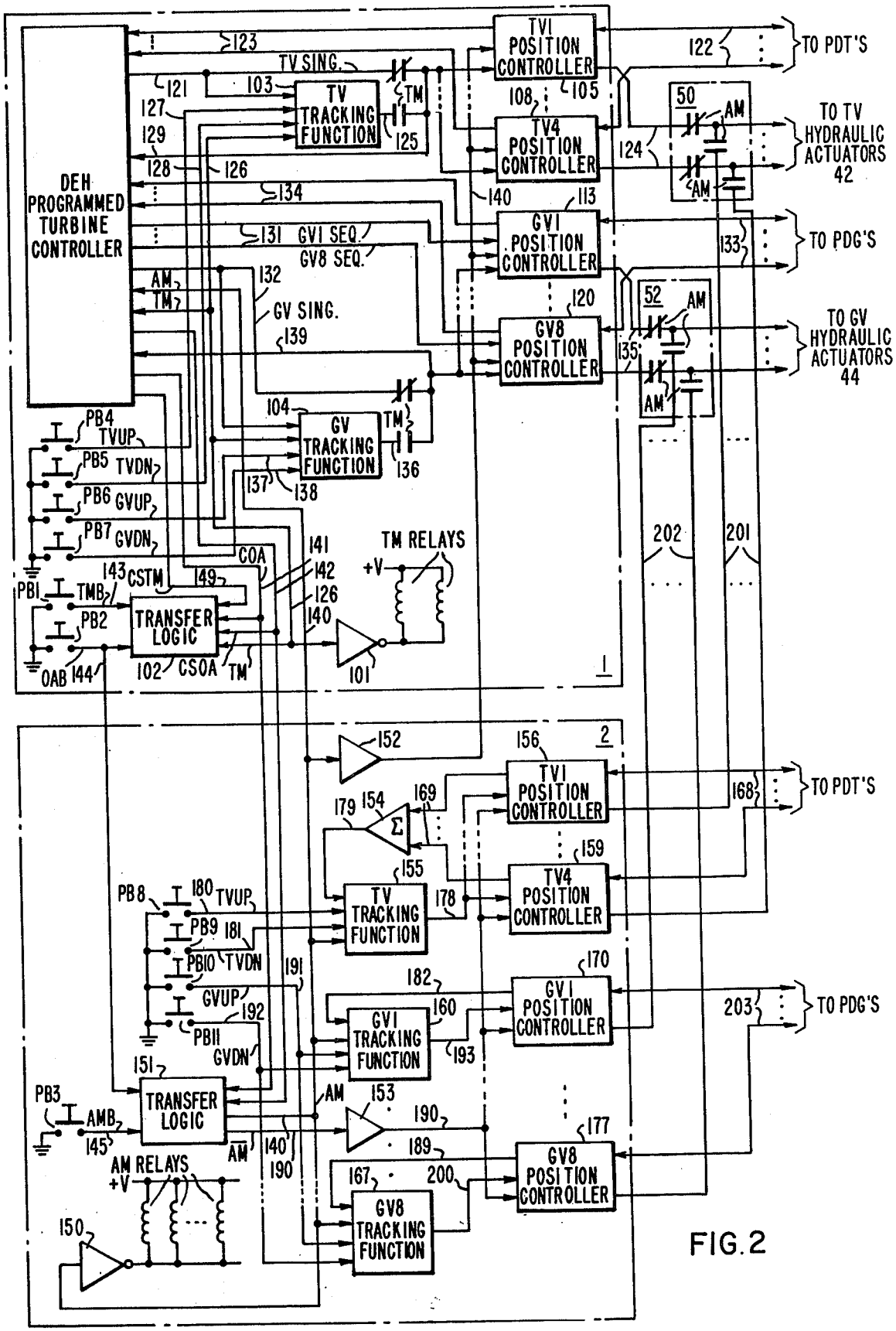
FIG. 2 is a schematic block diagram of one embodiment of the present invention.

More specifically as shown in FIG. 2, the position of each throttle valve TV1, . . . , TV4 is controlled by throttle valve (TV) position controllers 105, . . . , 108, respectively, at times when a plurality of normally-closed (NC) contacts of switch arrangement 50 are closed. A common position setpoint 121 is provided to the TV position controllers 105, . . . , 108 by a programmed DEH turbine controller 100 of turbine controller 1 similar to that disclosed in the aforementioned referenced U. S. Pat. Nos. 3,934,128 and 3,878,401. A plurality of position signals 122 are provided from the TV position detectors PDT1, . . . , PDT4 to the TV position controllers 105, . . . , 108, respectively, to be used as position feedback signals. The errors between each TV position signal 122 and the common TV position setpoint 121 are operated on by their corresponding position controller 105, . . . , 108 to generate a plurality of position control signals 124 which are coupled to the TV hydraulic actuators 92 through the NC auxiliary manual (AM) contacts of switch arrangement 50. A plurality of position signals 123 are provided to the turbine controller 100.

The position of each governor valve GV1, . . . , GV8 is controlled by governor valve position controllers 113, . . . , 120, respectively, at times when a plurality of NC contacts of switch arrangement 52 are closed. A plurality of sequential position setpoints 131 are coupled to each GV position controller 113, . . . , 120 for purposes of controlling the governor valves GV1, . . . , GV8 in a "sequential" valve position mode control as previously described in the Background. A common position setpoint signal 132 is also coupled to each GV position controller 113, . . . , 120 for purposes of controlling the governor valves GV1, . . . , GV8 in a "single" valve position mode control. Both sets of signals 131 and 132 are generated by the DEH type turbine controller 110. The valve positions are generally not controlled mutually by both the "sequential" and "single" modes, except for a few exceptional cases; one being the transfer of control to DEH manual, for example. This will become more apparent in the description of the DEH manual operation herebelow. Position signals 133 are provided to each of the GV position controllers, 113, . . . , 120 by the governor valve position detectors PDG1, . . . , PDG8, respectively. A plurality of GV position signals 134 are sent to the DEH turbine controller 100 from each GV position controller 113, . . . , 120. An error is generated within each GV position controller 113, . . . , 120 between the designated setpoint signal and the corresponding position signal 133. The generated errors are operated on by each corresponding GV position controller to produce a plurality of GV position control signals 135 which are coupled to the GV hydraulic actuators 44 through the plurality of NC AM contacts of switch arrangement 52. A more detailed description of a typical TV or GV position control loop is provided herebelow.

Also included in the turbine controller 1 is a manual controller which is similar to that disclosed in U.S. Pat. Nos. 3,741,246 and 3,891,344 both titled "Steam Turbine System With Digital Computer Position Control Having Improved Automatic-Manual Interaction" both by A. S. Braytenbah, being issued June 26, 1973 and June 24, 1975, respectively, which are incorporated by reference herein for a more detailed understanding thereof. The DEH manual controller comprises a TV tracking function 103 and a GV tracking function 104. When the turbine controller 1 is in the automatic mode (i.e., the TV and GV positions are controlled by the DEH controller 100), both the TV and GV tracking functions 103 and 104 are tracking their respective "single" mode setpoint signals 121 and 132 generated by the DEH controller 100. As a result of the tracking operations of 103, a position setpoint signal 125 is produced which is essentially equal in value to signal 121. Similarly, as a result of the tracking generation of 104, a position setpoint signal 136 is produced which is essentially equal in value to signal 132. At times when DEH manual is selected, NC turbine manual (TM) contacts open and normally open (NO) TM contacts close, thereby permitting TV manual position setpoint 125 and GV manual position setpoint 132 to control the TV and GV position controllers, respectively.

The signal TV UP 127 and TV DN 128 are supplied from the pushbuttons PB4 and PB5 to the TV tracking function 103 to increase and decrease the value of the TV manual position setpoint 128. Similarly, signals GV UP 137 and GV DN 138 are supplied from the pushbuttons PB6 and PB7 to the GV tracking function 104 to increase and decrease the GV manual position signal 136. Turbine manual (TM) signal 126 must be logically true to permit manual operation of the TV and GV tracking functions. A more detailed description of a typical tracking function is provided herebelow. Transfer logic 102 is incorporated into the turbine controller 1 for purposes of effecting a transfer between DEH controllers 100 and the TV and GV tracking functions 103 and 104. Said control transfer is executed upon reception of either a logical true signal over signal line 143 or a logical true signal 143 is in response to the depression of pushbutton PB1 (TMB) and the logical true signal 149 is in response to detection of malfunction in the DEH controller 100. The transfer logic 102, which will be described in better detail herebelow, effects a true state on TM signal line 126 which is supplied to both TV and GV tracking functions. A logical true signal 126 also energizes TM relays utilizing a typical relay driver 101 to open the NC TM contacts and close NO TM contacts which, in turn, transfers position setpoint control from the DEH controller 100 to the TV and GV tracking functions 103 and 104 as described above. Transfer to the DEH manual generally occurs automatically as a result of a malfunction detected in the DEH controller 100 (i.e., CSTM, signal line 149 set logically true). One purpose of the automatic transfer is to keep the turbine-generator "one-line" producing power, without disturbance, until the turbine control can be transferred to the auxiliary manual controller 2.

Accordingly, while the valve position controllers are under the control of the TV and GV tracking functions, the DEH automatic controller 100, if operational, may use conventional programming to equate the common TV position setpoint signal 121 to the controlling TV position setpoint signal read over signal line 129 and to equate the common GV position setpoint signal 132 to the controlling GV position setpoint signal read over line 139. If the above tracking procedure is successfully accomplised as indicated by the differences between the controlling position setpoints read and the corresponding position setpoints equated thereto wherein the differences must be less than a predetermined value, then a logic true signal (CSOA) 142 is provided to the transfer logic 102 indicating that the automatic controller 100 is ready to accept control. Only if the signal 142 is logically true will the transfer logic 102 respond to a depression of pushbutton PB2 (OAB) over signal line 144 by attempting to transfer control to the automatic controller 100 by causing the signal TM 126 to be logically false. If the automatic controller 100 accepts control after receiving a false indication over signal line 126, it responds by generating a logical true signal (COA) 141 acknowledging acceptance of control transfer. If the transfer logic 102 receives a logical true signal 141 within a predetermined time sequentially after TM signals 126 was affected false, then the TM signal 126 is maintained in the false state; otherewise, the TM signal 126 is reverted to a true state. When the DEH automatic controller 100 accepts a control, the TM relays, energized by relay driver 101, previously mentioned hereinabove, are de-energized causing the NO TM contacts to open and the NC TM contacts to close. The position setpoints are controlled by the DEH automatic controller 100 in this state. It is understood that the operation described above occurs when the auxiliary manual controller 2 has not been selected to control the turbine-generator. This will become apparent through the description of the auxiliary manual controller 2 found below.

It is possible for a control transfer to DEH manual control to occur while in "sequential" mode operation. Under these conditions, the "sequential" valve position setpoints 131 are maintained. The GV tracking position 104, utilizing its signal lines 137 and 138, may control the "single" valve setpoint 139, for example. The "sequential" valve position setpoints 131 may then be determined by subtracting, from each valve position signal of the plurality of position signals 134, the value of the "single" valve setpoint 139. Registers within the DEH controller 100 may be updated periodically under conventional program control to the "sequential" valve position settings for use in automatic control. The "single" valve setpoint 132 may also be updated periodically to essentially equal the value of the signal 139 by the DEH controller 100. A typical criteria for successful tracking is that each difference between a "sequential" plus "single" valve setpoint composite value and a corresponding position signal is less than a predetermined value. When this criteria is satisfied, the signal 142 (CSOA) may be set logically true as one indication that the DEH automatic controller 100 is ready to accept control. A control transfer to the DEH controller 100 is executed and accepted in a similar manner as described above.

Referring now to the auxiliary manual (AM) controller 2 of FIG. 2, the position of each throttle valve TV1, . . . , TV4 is controlled by throttle valve position controllers 156, . . . , 159, respectively, at times when the plurality of normally-open (NO) contacts of switch arrangement 50 are closed. A common position setpoint 178 is provided to each of the TV position controllers 156, . . . , 159 by a TV tracking function 155. A plurality of position signals 168 are provided from the TV position detection PDT1, . . . , PDT4 to the TV position controllers 156, . . . , 159, respectively, for use as position feedback signals. The errors between each TV position signal of the plurality of position signals 168 and the common TV position setpoint 178 are operated on by their corresponding position controllers 156, . . . , 159 to generate a plurality of position control signals 201 which are coupled to the TV hydraulic actuators 42 trough the NO AM contacts of switch arrangement 50. A plurality of position signals 169 are averaged in a typical summing amplifier 154. An average TV position signal 179 is provided to the TV position controller 155. The controller 155 tracks the TV average signal 179, by essentially equating the signal 178 to signal 179, at times when the signal AM 140 is logically false. When the signal AM 140 is logically true, the tracking operation of 155 is inhibited and the TV position setpoint 178 is controlled by the TV tracking function 155 in accordance with the TV UP and TV DN signals 180 and 181 in response to the pushbuttons PB8 and PB9, respectively. This operation will become clearer in the description of a typical tracking function found herebelow in connection with FIG. 4.

Also, the position of each governor valve GV1, . . . , GV8 is controlled by GV position controllers 170, . . . , 177, respectively, at times when the plurality of NO contacts of switch arrangement 52 are closed. A plurality of position setpoints 193, . . . , 200 are provided to each GV position controller 170, . . . , 177, by a plurality of GV tracking functions 160, . . . , 167, respectively. A plurality of position signals 203 are provided from the GV position detectors PDG1, . . . , PDG8 to the GV position controllers 170, . . . , 177, respectively. Each GV tracking function tracks a position signal from its corresponding GV position controller at times when the signal AM 140 is logically false. For example, GV tracking function 160 essentially equates its position setpoint 193 to the position signal 182 received from position controller 170. And similarly, GV tracking function 167 essentially equates its position setpoint 200 to the position signal 189 received from the corresponding position controller 177. At times when the signal AM 140 is true, the tracking operation of the functions 160, . . . , 167 are inhibited and the position setpoints 193, . . . , 200 are increased and decreased uniformly by the GV UP and GV DN signals 191 and 192 in accordance with the pushbuttons PB10 and PB11, respectively.

Transfer logic 151 is incorporated in the auxiliary turbine controller 2 for purposes of conducting a transfer of control operation between the DEH turbine controller 1 and the auxiliary turbine controller 2. A control transfer from turbine controller 1 to turbine controller 2 is executed in response to a logical true state on signal line 145 which is effected by depression of pushbutton PB3 (AMB). The transfer logic 151 responds by setting the signal AM 140 logically true. A logical true signal AM 140 energizes AM relays utilizing a typical relay driver 150. The relays control the opening of the NC AM contacts of switch arrangements 50 and 52 and the closing of the NO AM contacts of switch arrangements 50 and 52. In this state, the TV and GV steam admission valves are closed-loop controlled by position controllers 156, . . . , 159 and 170, . . . , 177 utilizing the plurality of position control signals 201 and 202.

The AM signal 140 is also coupled to position controllers 105, . . . , 108 and 113, . . . , 120 through buffer 152. At times when AM signal 140 is logically true, the plurality of position control signals 124 and 135 are maintained at a zero potential level which will become clearer in the description of the position controller found herebelow in connection with FIG. 3. It is apparent that when the AM signal 140 is true, the position control signals 124 and 135 are disconnected from controlling the TV and GV hydraulic actuators 42 and 44, respectively, because the NC AM contacts of switch arrangements 50 and 52 are open thereby breaking the electrical circuit. Accordingly, when the signal AM 140 is logically false, its complement signal AM 190 is logically true. The signal AM 190 is buffered by 153 and coupled to position controllers 156, . . . , 159 and 170, . . . , 177. When signal AM 190 is logically true, the plurality of position control signals 201 and 202 are maintained at a zero potential by the position controllers 156, . . . , 159 and 170, . . . , 177. It is also apparent that when the signal AM 140 is false (i.e., AM ≡ true), the position control signals 201 and 202 are disconnected from controlling the TV and GV hydraulic actuators 42 and 44, respectively, because the NO AM contacts of switch arrangements 50 and 52 are open, thereby breaking the electrical circuit therebetween.

As previously mentioned, the primary purpose of transferring turbine control to the auxiliary manual controller 2 is to remove power from and service turbine controller 1. After being serviced, the turbine controller 1 may be returned to power. The DEH automatic turbine controller 100 of turbine controller 1, under the conditions of just returning to powered operation, may perform the previously described tracking procedures using programs conventional to DEH controllers of this type. Upon returning to powered operation, the turbine controller 1 may revert control to the TV and GV tracking function 103 and 104 (i.e., TM = true) and the TV and GV position setpoints 125 and 126 thereof may be initialized to zero potential. The TV "single" position setpoint 121 may be set equal to the average of the TV position signals 123 which are, under normal conditions, approximately equal. Since the GV "single" position setpoint 139 is at zero potential, the GV position setpoint registers within the DEH automatic turbine may be set equal to their corresponding position signals read over signal lines 134. This tracking procedure is performed under the conventional program control of the DEH controller 100 during times when the auxiliary manual control (i.e., AM = true) is controlling the position of the steam admission valves of the turbine.

When all of the position setpoint registers of the DEH controller 100 are set approximately equal to their corresponding position signals, the signal (CSOA) 142 is effected to a logical true state as one possible indication that the DEH controller 100 is ready to accept control. Neither transfer logic 102 nor 151 can respond unless signal 142 provided thereto is logicaly true. A transfer of control between the auxiliary manual controller 2 and DEH controller 100 is undertaken at the time signal 144 is made logically true in response to depression of pushbutton PB2 (OAB). Pushbutton PB2 is also coupled to transfer logic 102 over a common line 144. Both transfer logic systems 102 and 151 respond by setting the signals TM 126 and AM 140, respectively, logically false. The DEH controller 100 senses the false state of signals 126 and 140 and responds by setting COA signal 141 logically true which is an indication to both 102 and 151 that the controller 100 has accepted turbine control. If the signal 141 is set logically true within a predetermined time sequentially after setting TM and AM signals false, then both TM and AM signals remain false; otherwise, they are reverted to their logical true states.

With acceptance of control by the DEH controller 100, (i.e., both TM and AM are logically false), relays AM and TM are de-energized causing the NC TM contacts to close and the NO TM contacts to open and causing the NC AM contacts of switch arrangements 50 and 52 to close and NO AM contact of switch arrangements 50 and 52 to open, thereby transferring closed-loop position control of the steam admission valves to the position controllers 105, . . . , 108 and 113, . . . , 120. Concurrent with the de-energization of the TM and AM relays of 1 and 2, respectively, the signal AM 140 supplied to the position controllers 105, . . . , 108 and 113, . . . , 120 is set logically false, thereby the position control signals 124 and 135 are no longer maintained at zero potential, but permitted to respond to the position errors of said position controllers. Also, the signal AM (complement of AM) 190 supplied to the position controllers 156, . . . , 159 and 170, . . . , 177 is set logically true, thereby the position control signals 201 and 202 are maintained at zero potential by said position controllers and are unresponsive to the position error signals generated therein.

Figure 3:
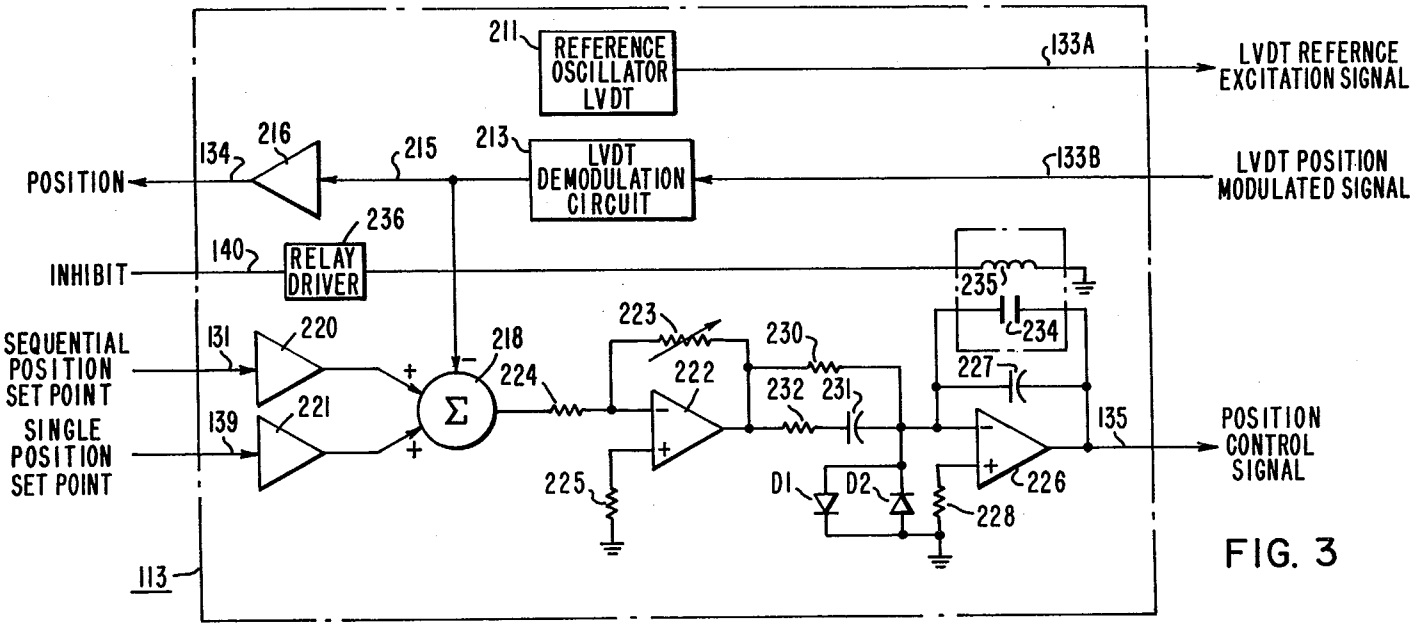
FIG. 3 is a schematic diagram of the position controller used in the embodiment of FIG. 2.

Referring to FIG. 3, GV position controller 113 of FIG. 2 enclosed by dotted lines is chosen as a typical position controller. The position detectors PDG1, . . . , PDG8 as shown in FIG. 1 may be of the linear variable differential transformer (LVDT) type. In general, a reference excitation signal, usually a sinusoidal waveform of a constant amplitude and frequency, is supplied to the primary of the LVDT. Said excitation signal 133A is generated by the reference oscillator 211. Accordingly, the LVDT normally modulates the amplitude of the excitation signal provided to its primary according to the position of its core material. A position modulated signal is generated at the secondary of the LVDT. Generally, the core of the LVDT is linked to the valve stem whereby core movement is proportional to valve position. The amplitude of the position modulated LVDT signal 133B is generally proportional to the valve position. The signal 133B is demodulated by a typical LVDT demodulation circuit 213 to produce a D.C. signal 215, the amplitude of which may be proportional to the corresponding valve position. The position signal 215 is buffered by a conventional buffer amplifier 216 to generate a position signal 134 which is typical of those position signals generated by the position controllers in the schematic diagram shown in FIG. 2.

A "sequential" position setpoint, similar to signal 131 of FIG. 2, is signal conditioned by a signal conditioning amplifier 220 and provided to the position controller closed-loop summing junction 218. Likewise, a "single" position setpoint, similar to signal 139 of FIG. 2, is signal condition by a conventional signal conditioning amplifier 221 and provided to the summing junction 218. The composite of the signal conditioned signals 131 and 139 consititutes the position setpoint for the particular controller 113 which is characteristic of all of the position controllers of FIG. 2. The position feedback signal is provided to the summing junction 218 by signal 215 and is inverted such that it is subtracted from the composite setpoint. A position error signal resulting from the summation of 218 is operated on by a proportional plus integral type controller comprising circuit arrangements of amplifiers 222 and 226. A conventional gain amplification is performed by the circuit arrangement comprising operational amplifier 222 and resistors 225, 224 and variable resistor 223. Variable resistor 223 adjusts the closed-loop gain around the amplifier 222. The cascaded circuit arrangmeent which operates on the amplified error signal of operational amplifier 222 characterizes the transfer function, normally referred to as proportional plus integral, having a "zero" in the numerator, wherein the time constant of the "zero" is defined by the summation of resistors 230 and 232 multiplied by the capacitance 231; and having an integral in the denominator, where the time gain of the integrator is defined by the resistor 230 multiplied by the feedback capacitance 227. The value of resistor 232 is normally selected on the order of one-hundredth of the resistor 230; therefore the contribution of the "pole" formed by resistor 232 and capacitance 231 may be considered negligible. Diodes D1 and D2 eliminate the possibility of the capacitor 227 being completely charged. Resistor 228 sets ground potential as the normal functioning common mode potential of the inverting and non-inverting inputs of amplifier 226. Amplifier 226 may be comprised of one or more operational amplifiers and current boosters.

A relay 235 is included in the typical position controller 113. The relay 235 is energized by a conventional relay driver circuit 236 at times when an inhibit control signal, such as signal AM 140, is logically true. When relay 235 is energized, the normally open contacts 234 close thereby shorting the output of amplifier 226 to the potential of the inverting input of 226, which is at approximately ground potential established by resistor 228. The output signal 135 of the amplifier, which is the position control signal output of the position controller 113, is maintained at approximately ground potential while relay 235 is energized and the inhibit signal (AM 140 in this example) is logically true. At times when the relay 235 is not energized (i.e., inhibit signal is false), the output signal 135 of amplifier 226 is free to respond to the amplified position error of amplifier 222. This description in connection with FIG. 3 exemplifies the operation of the position controllers of FIG. 2.

Figure 4:
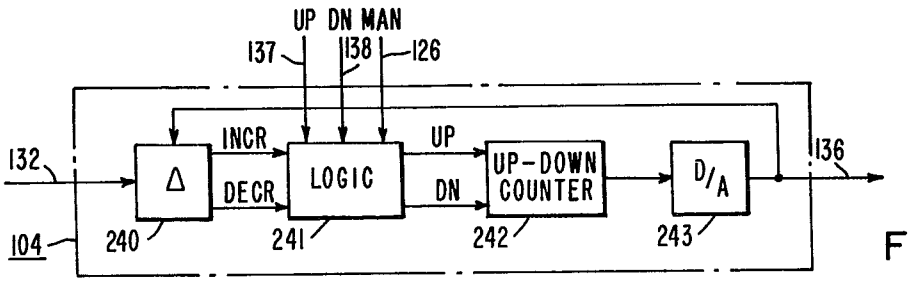
FIG. 4 is a schematic block diagram of the tracking function used in the embodiment of FIG. 2.

Referring to FIG. 4, GV tracking function 104 enclosed by the dotted lines is chosen as a typical tracking function used in the schematic diagram of FIG. 2. The GV "single" position setpoint 132 which is typical of an output provided to the tracking function of FIG. 2 is compared with the output signal 136 in the comparator function 240. If the tracking function 104 is in the tracking mode defined by the MAN signal 126 being logically false, then the comparator 240 utilizing the logic functions of 241 controls the up and down counting of counter 242. As an example, if signal 132 is greater than signal 136, the comparator 240 responds by setting the INCR output logically true and the DECR output logically false. It is assumed that the MAN signal 126 is logically false for this example, in which case, the logic 241 responds only to the INCR and DECR inputs. Therefore, the UP output of 241 is set logically true and the DN output is set logically false, thereby causing the counter 242 to increase in count at a predetermined rate. The counter 242 is coupled to a digital-to-analog (D/A) converter 243 which converts the digital output of the counter 242 to a proportional analog value. So as the counter increases in count, the analog signal 136, output of D/A 243, also increases until signal 136 is greater than signal 132. At this time, comparator 240 sets INCR false and DECR true and accordingly, logic function 241 sets UP false and DN true which controls counter 242 to count down. The analog signal 136 again proportionately follows the output of the counter 242. In this manner, the output signal 136 tracks the input signal 132.

At times when MAN signal 126 is set true, the logic function 241 no longer responds to the INCR and DECR inputs and the counter responds only to the UP and DN logic function input signals 137 and 138, respectively. The count in counter 242 and corresponding analog signal 136 may be increased by providing a logical true on signal line 137; likewise, the counter 242 and corresponding analog signal 136 may be decreased by providing a logical true on signal line 138. A more detailed description of the tracking functions can be found in the previously referenced U.S. Pat. Nos. 3,741,246 and 3,891,344. This description in connection with FIG. 4 exemplifies the operation of the tracking functions of FIG. 2.

Figure 5:
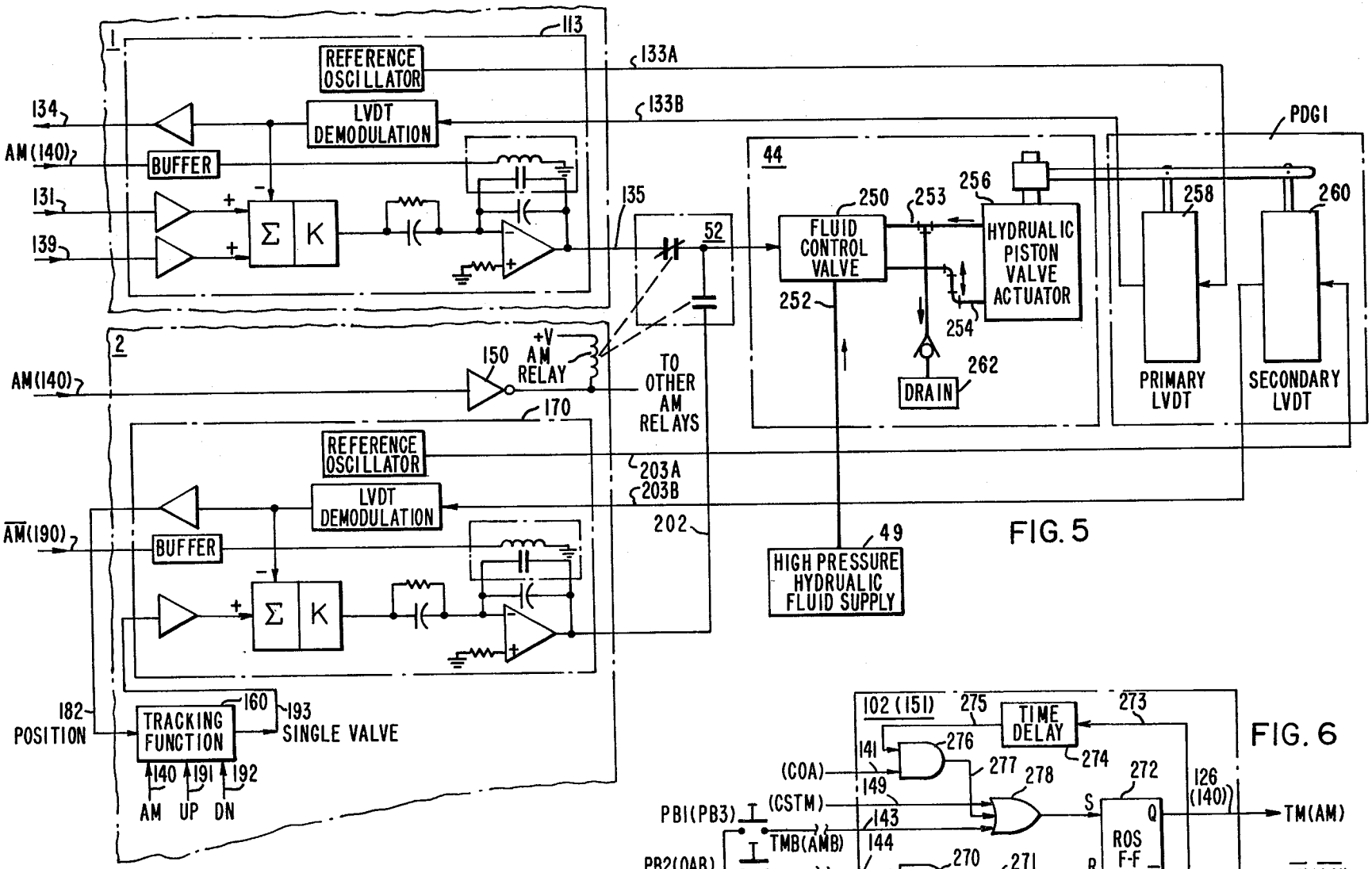
FIG. 5 shows a more detailed schematic block diagram of the transfer apparatus for one steam admission control valve in accordance with the embodiment of FIG. 2.

A typical control transfer from turbine controller 1 to the auxiliary manual controller 2 is described here in connection with FIG. 5. The position controllers 113 and 170 are chosen from turbine controllers 1 and 2, respectively, to illustrate an example of transfer control therebetween. Assuming to start that signal AM 140 is false, in which case its complement AM 190 is true, then the position control signal 135 is free to respond to the operation of position controller 113 on its position error generated therein. Accordingly, the position control signal 202 is maintained at zero potential in accordance with the closed contacts of the energized inhibit relay contained in the position controller 170. The valve position detector PDG1 may comprise a primary LVDT 258 and a secondary LVDT 260, each commonly linked to a hydraulic valve actuator 256 in the plurality of GV hydraulic actuators 44 such that the core of both LVDT 258 and 260 move together corresponding to the position movement of steam admission valve GV1. Position controller 113 provides the reference excitation signal 133A to the primary LVDT 258 of PDG1 and the position modulated signal is coupled back to controller 113 over signal line 133B. As has been previously described above, the position controller 113 demodulates the position modulated signal to generate a position signal to be used as the position feedback signal therein. The demodulated position signal is also coupled to the DEH controller 100 over signal line 134.

A typical hydraulic valve actuator in the plurality of hydraulic valve actuators 44 comprises a conventional fluid control valve 250 and a hydraulic piston valve actuator 256. Hydraulic fluid is supplied to one part of the fluid control valve 250 over line 252 from the hydraulic fluid supply 49. Another part of valve 250 is attached to a hydraulic drain 262 over line 253. The flow of hydraulic fluid either into or out of the piston valve actuator 256 over line 254 is controlled by the fluid control valve 250 in accordance with either position control signals 135 or 202 depending on the state of switch arrangement 52. Assuming that AM 140 is false, the AM relay is de-energized and control of fluid valve 250 is affected by position control signal 135. Thus, as new position setpoints 131 and 139 are established, the position controller 113 operates on the position error generated therein to produce a new position control signal 135. Signal 135 controls the hydraulic fluid to the piston valve actuator 256. Said fluid flow effects a rate of movement of the piston of 256 which is linked to the stem of steam admission valve GV1; therefore, the position control signal 135 controls the rate of position movement of GV1. The position of GV1 is detected by the primary LVDT 258 which continuously sends a position signal over line 133B to position controller 113. As the position error of 113 decreases (i.e., the actuator valve position is converging to the setpoint), the position control signal 135 decreases until, at steady-state condition, no more fluid flow is needed and the signal 135 is essentially zero potential. The typical loop response time is approximately in the order of 1 to 3 seconds; therefore, it is more than likely that the valve position controllers, such as 113, are controlling close to steady-state conditions most of the time and the position control signals, such as 135, are at essentially zero potential most of the time.

Since it was assumed that signal AM 140 is false to start our example, then the tracking function 160 of auxiliary manual controller 2 is tracking the position signal 182 with its setpoint generated signal 193 to ensure that the position error of controller 170, typical of the controllers of system 2, is maintained at zero potential. The position control signal 202 of 170 is also maintaned at zero potential by the inhibit relay as described above. Position controller 170 cooperates with the secondary LVDT 260 of PDG1 over signal lines 203A and 203B in a similar manner as controller 113 cooperates with LVDT 258, which is typical of all the position controllers of the embodiment in connection with FIG. 2, to attain the actual valve position representative signal. Under these conditions the auxiliary manual controller 2 is ready to accept control from the DEH turbine controller 1 at any time without effecting a significant position movement of any of the steam admission valves. This is more commonly referred to as a "bumpless transfer".

As the transfer logic 151 sets AM 140 true in response to the depression of pushbutton PB3 (AMB), the plurality of AM relays are energized thereby transferring control of the fluid control valve 250 from position control signal 135 to position control signal 202, for example. The inhibit relay of position controller 113, typical of all the position controllers of turbine controller 1, is energized and the position control signal 135 is maintained at zero potential while signal AM 140 is true. Concurrently, the inhibit relay of position controller 170, which is typical of all the position controllers of the auxiliary manual controller 2, is de-energized and the position control signal 202 responds to the closed-loop position control operation of controller 170. The position setpoint 193 of controller 170 may be increased or decreased by applying a logically true to signal 191 or 192, respectively. A description of a typical tracking function has been provided hereinabove. If the turbine controller 1 is at power and operating while the auxiliary manual 2 is controlling the turbine valves, the DEH controller 100, as shown in FIG. 2, periodically monitors the position signals, such as signal 134, and setpoint 139 and sets the corresponding internal position setpoint registers such that a position error of zero is maintained in each position controller in turbine controller 1 of which 113 is typical. With the position errors and position control signals both approximately at zero potential, turbine controller 1 is ready to accept control with a "bumpless transfer". The transfer from the auxiliary manual controller 2 to the turbine controller 1 may best be described in connection with a description of FIG. 6.

Figure 6:
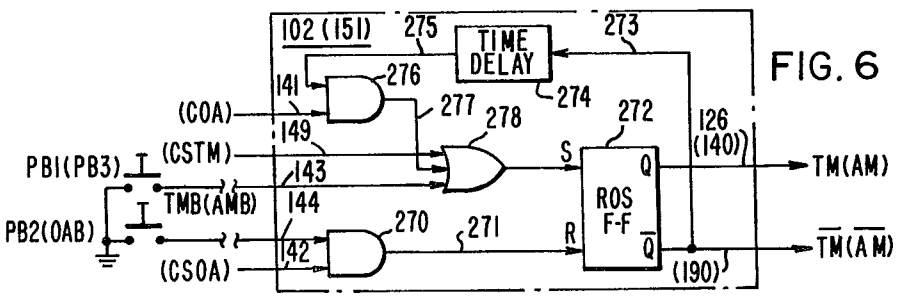
FIG. 6 is a schematic diagram of the transfer logic in accordance with the embodiment of FIG. 2.

In FIG. 6 is shown a typical schematic of the transfer logic functions 102 and 151. Assuming the transfer logic 102 (151) is in the state in which TM (AM) is logically true and ($\overline{AM}$) is logically false. The transfer logic is reset by AND gate 270 effecting a logical true signal over line 271. The AND gate 270 is disabled as long as signal line (CSOA) 142 is logically false; therefore, unresponsive to the pushbutton PB2 (OAB). When signal (CSOA) 142 becomes logically true indicative of the DEH controller 100 of FIG. 2 ready to accept turbine control, the AND gate 270 is enabled to respond to the OAB PB2 initiating a transfer to turbine controller 1. A resulting logical true 271 resets a reset-over-set (ROS) flip-flop (FF) 272 such that $\overline{AM}$ 190 is logically true and TM (AM) 126 (140) is logically false. The $\overline{Q}$ output of the conventional ROS FF 272 also effects a logical true state at the input to a typical time delay circuit 274 over signal line 273. The output 275 of time delay 274 is delayed from responding by a predetermined time delay, generally on the order of 1 to 2 seconds for this embodiment, set within the time delay 274. If the signal 141 (COA) is not set logically false by the DEH controller 100, acknowledging acceptance of control in response to the logically false signal 126 (140), to disable the AND gate 276 within the predetermined time delay of 274, then the AND gate 276 will respond to the delayed logically true signal over line 275 and effect a true signal over line 277. The OR gate 278 reacts to the logically true signal 277 by setting the ROS FF 272 thereby producing signal 126 (140) true and signal ($\overline{AM}$) 190 false. In this example, the DEH controller 100 did not accept turbine control. If the COA signal 141 is set logically true by the controller 100 upon reception of a logical false signal over line 126 (140) within the predetermined time delay period, then AND gate 266 is disabled and cannot respond to the delayed logical true signal 276. The ROS FF 272 will be maintained in the state in which the signal 126 (140) is logically false and signal 190 is logically true. In this example, a transfer is accepted by the DEH controller 100 and turbine control is transferred to turbine controller 1 as previously described hereinabove.

Thereafter, the transfer logic 102 (151) may respond to either signal 149 (CSTM) or signal 143 TMB (AMB) being set logically true by setting ROS FF 272. If the pushbutton (AMB) PB3 is depressed, the signal AM 140 is set logically true and $\overline{AM}$ 190 is set logically false by the transfer logic 151 which results in the turbine control transfer from turbine controller 1 to auxiliary manual controller 2.

To summarize, the hydraulic fluid flow control signals which control the rate of position movement of their corresponding steam admission valves, exemplified in FIG. 5, are utilized as the signals which are physically switched to transfer control between the auxiliary and primary turbine controllers 2 and 1, respectively. These position control signals are normally at a value close to zero potential when close-loop controlling the valve positions with the position setpoint at steady-state. Redundant LVDT's for each steam admission valve supply position feedback signals to each corresponding position controller of both the primary and auxiliary systems as shown in FIG. 5. The set of position control signals, not selected for control by switch arrangements 50 and 52, are maintained at zero potential within each position controller using the inhibit circuitry described in connection with FIG. 3. Since the position control signals of both the controlling and non-controlling position controllers are both close to zero potential and since these signals are hydraulic flow control signals which control the rate of valve position movement, then transfer of control therebetween will result in no significant instantaneous valve position movement. Valve position movement after transfer is eliminated for the most part by providing zero potential position errors as a result of the tracking functions used in the primary and auxiliary systems in preparation of a transfer of control thereto, as the case may be.

The conventional programming associated with a DEH type turbine controller may be utilized in the preparation of transfer of control from the auxiliary manual system 2 to the primary system 1 as described in connection with FIG. 2. The transfer logic of FIG. 6 provides for acknowledging acceptance of control by the primary DEH type controller to complete the execution of transfer of turbine control thereto.

I claim:

1. A steam turbine control system comprising:

a source of steam;

a steam turbine;

a plurality of steam admission control valves coupled between said steam source and said steam turbine to control the steam flow passing through said steam turbine from said steam source, said steam flow being a function of the position of each of said steam admission control valves;

a rate control means for each steam admission control valve, each of said rate control means being coupled to a corresponding steam admission control valve for controlling the rate of position movement therein;

a position detection means for each steam admission control valve, said each position detection means operative to generate a primary and an auxiliary valve position signal, both representative of the actual position of their corresponding steam admission control valve;

a primary turbine controller governed at times by said primary valve position signals to generate a set of valve position control signals, each valve position control signal corresponding to a steam admission control valve;

an auxiliary turbine controller governed at times by said auxiliary valve position signals to generate a set of auxiliary valve position control signals, each valve position control signal corresponding to a steam admission control valve; and switching means operative to select one of the primary and auxiliary sets of valve position control signals to govern their respective rate of control means which controls the rate of position movement of each of the steam admission control valves.

2. A steam turbine control system according to claim 1 wherein the primary turbine controller includes a valve position controller corresponding to each steam admission control valve, each valve position controller comprising: means governed by a predetermined position setpoint and the primary valve position signal of the corresponding steam admission control valve to generate a position error signal, said position error signal being the algebraic difference between said predetermined position setpoint and said primary valve position signal; and control means governed by said position error signal to generate the valve position control signal which may govern the rate of position movement of the corresponding steam admission control valve, whereby each valve position controller of the primary turbine controller may perform closed-loop valve position control of its corresponding steam admission valve.

3. A steam turbine control system according to claim 2 wherein at times when the auxiliary set of valve position control signals are selected by the switching means, the position error signal and valve position control signal of each of the valve position controllers included in the primary turbine controller are maintained at a value which will effect no significant position movement of the steam admission control valves.

4. A steam turbine control system according to claim 1 wherein the auxiliary turbine controller includes a valve position controller corresponding to each steam admission control valve, each valve position controller comprising: means governed by a predetermined position setpoint and the auxiliary valve position signal of the corresponding steam admission valve to generate a position error signal, said position error signal being the algebraic difference between said predetermined position setpoint and said auxiliary valve position signal; and control means governed by said position error signal to generate the valve position control signal which may govern the rate of position movement of the corresponding steam admission control valve, whereby each valve position controller of the auxiliary turbine controller may perform closed-loop valve position control of its corresponding steam admission valve.

5. A steam turbine control system according to claim 4 wherein at times when the primary set of valve position control signals are selected by the switching means, the position error signal and valve position control signal of each of the valve position controllers included in the auxiliary turbine controller are maintained at a value which will effect no significant position movement of the steam admission control valves.

6. A steam turbine control system according to claim 1 wherein the auxiliary turbine controller permits the switching means to maintain selection of the primary set of valve position control signals only at times when the primary turbine controller provides an indication of control acceptance to the auxiliary turbine controller.

7. A system to close-loop control the valve stem position of a turbine steam admission valve comprising:

position detection means to generate a primary and an auxiliary representative valve stem position signal;

primary electronic position setpoint controller governed by the difference between the primary representative valve stem position signal and a predetermined primary position setpoint to generate an electrical primary valve position control signal;

auxiliary electronic position setpoint controller governed by the difference between the auxiliary representative valve stem position signal and a predetermined auxiliary position setpoint to generate an electrical auxiliary valve position control signal;

selecting means operative to select one of the electrical primary and auxiliary valve position control signals;

hydraulic fluid flow control valve governed by the selected one of said electrical primary and auxiliary valve position control signals to generate hydraulic fluid flow; and hydraulic valve actuator coupled to the stem of said turbine steam admission valve, said hydraulic valve actuator being responsive to said generated hydraulic fluid flow for positioning said valve stem at a rate proportional to said hydraulic fluid flow.

8. A system according to claim 7 including:

a primary tracking means operative at times when the auxiliary valve position control signal is selected by the selecting means, to reduce the difference between the primary position setpoint and the primary representative valve stem position signal to zero;

a primary inhibit means operative, at times when the auxiliary valve position control signal is selected by the selecting means, to maintain the primary valve position control signal at a value which will not generate hydraulic fluid flow from said hydraulic fluid flow control valve;

an auxiliary tracking means operative, at times when the primary valve position control signal is selected by the selecting means, to reduce the difference between the auxiliary position setpoint and the auxiliary representative valve stem position signal to zero; and an auxiliary inhibit means operative, at times when the primary valve position control signal is selected by the selecting means, to maintain the auxiliary valve position control signal at a value which will not generate hydraulic fluid flow from said hydraulic fluid flow control valve.

9. A system according to claim 8 wherein said selecting means is permitted to maintain selection of the primary valve position control signal only at times when the primary tracking means provides an indication of successful tracking to said selecting means.

* * * * *